United States Patent [19]

Dick

[11] 4,232,742

[45] Nov. 11, 1980

[54] FLAME-GUARD FOR ELECTRICAL INSTALLATIONS

[75] Inventor: Willy P. A. Dick, Huddinge, Sweden

[73] Assignee: Telefonaktiebolaget L M Ericsson, Stockholm, Sweden

[21] Appl. No.: 911,488

[22] Filed: Jun. 1, 1978

[30] Foreign Application Priority Data

Jun. 9, 1977 [SE] Sweden ..... 7706753

[51] Int. Cl.[3] ..... A62C 37/14

[52] U.S. Cl. ..... 169/58; 52/1; 52/232; 169/28; 428/43; 428/307

[58] Field of Search ..... 169/26, 28, 35, 42, 169/56, 57, 58; 428/43, 307, 921; 52/1, 232

[56] References Cited

U.S. PATENT DOCUMENTS

| | | | |
|---|---|---|---|
| 3,486,563 | 12/1969 | Cholin et al. | 169/26 |
| 3,654,996 | 4/1972 | Naglowsky | 169/42 X |
| 3,782,475 | 1/1974 | Schmidt | 169/57 X |
| 3,915,237 | 10/1975 | Roznieck | 169/28 X |

*Primary Examiner*—Robert J. Spar
*Assistant Examiner*—Fred A. Silverberg
*Attorney, Agent, or Firm*—Hane, Roberts, Spiecens & Cohen

[57] ABSTRACT

A flame-guard device for electrical installations which consists of a cable-shaped string of capsules. The capsules contain a flame-extinguishing substance, which is released in case the capsules are heated.

3 Claims, 4 Drawing Figures

FLAME-GUARD FOR ELECTRICAL INSTALLATIONS

FIELD OF THE INVENTION

The present invention relates to a flame-guard preferably for electrical installations.

PRIOR ART

During the past few years, risks have increasingly been observed related to modern power- and telephone cable installations in the case of fire in plants where such installations are to be found. A fire can become of more extensive proportions by expanding through cable inlets, drums and shafts. Additionally, the cables' plastic insulation can produce gases, which through their toxic effect can injure or render people unconscious so that they are unable to protect themselves. The gases can also, through their corrosive effect, cause serious damage to buildings and installations, even if the fire is quickly stopped.

In order to overcome these problems, power and telephone cable manufacturers have begun to produce flame-protected cables. These cables possess considerably improved fire-inhibiting qualities, i.e., they have less tendency to burn than conventional cables. Nevertheless, under unfavorable circumstances these cables can also burn and have a fire-spreading effect. Such unfavorable circumstances exist, for example, if flame-protected cables are attached to an already existing installation, which comprises conventional, non-flame protected cables.

SUMMARY OF THE INVENTION

An object of the present invention is to provide a flame-guard device with which cable installations comprising conventional installations can be protected. Another object is to provide an additive-guard for installations comprising exclusively flame protected cables or a mixture of flame protected and conventional cables. An additional object is to provide a flame-guard which in new installations makes it unneccessary to install a sprinkler system in the cable installations. Still another object is to provide a flame-guard device that does not disturb the running of cables at the increase of existing installations and that admits an adjustment of the flame-guard effect in dependence of the fire risk in various installations as much as in various sections of one and the same installation.

This is attained by the construction in which the flame-guard device comprises several capsules preferably arranged in a line and connected in a string, each one including a substance with flame-extinguishing qualities, the capsules being arranged to burst or open up when heated, thereby releasing a flame-extinguishing substance.

The flame-extinguishing substance, which at room temperature can be gaseous, fluid, or solid, consists of or produces through heating preferably halons, i.e., halogen substituted carbohydrates.

BRIEF DESCRIPTION OF THE DRAWINGS

Several embodiments of the invention will be described in connection with the accompanying drawing, in which.

DETAILED DESCRIPTION

Figure 1:
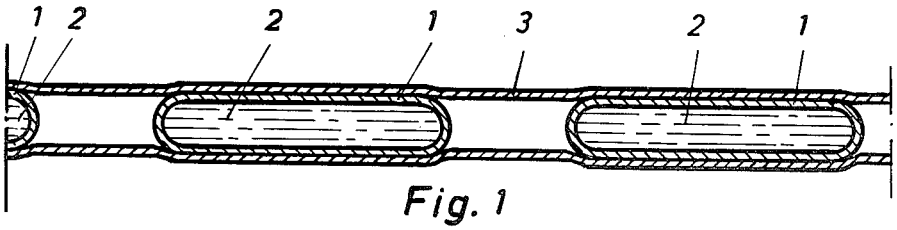
FIG. 1 is a cross-section through a capsule string in which capsules are connected by means of a hose, which surrounds the capsules.

FIG. 1 shows a capsule string, in which the capsules 1 are connected by means of a hose 3 which surrounds the capsules which contain fire-extinguishing material 2. The hose 3 is tightly wound around the capsules 1 so that these maintain their internal positions during handling of the capsule string. The capsules can be made of plastic, glass, or metallic material, shaped in such a manner that the material in the capsules either melts when exposed to the heat from a fire or burst due to the raised pressure in the capsules caused by the heat. The material 2 in the capsules is a flame-extinguishing substance consisting of a halon, or mixture of halons, or a halon producing substance.

Figure 2:
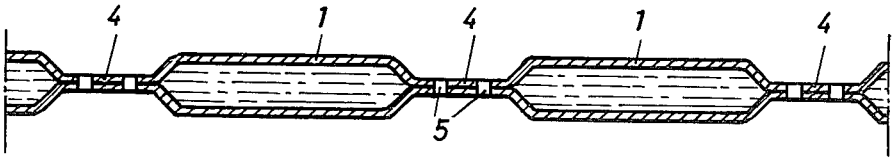
FIG. 2 is a cross-section through a capsule string, in which the capsules are formed by contraction of a hose.
Figure 3:
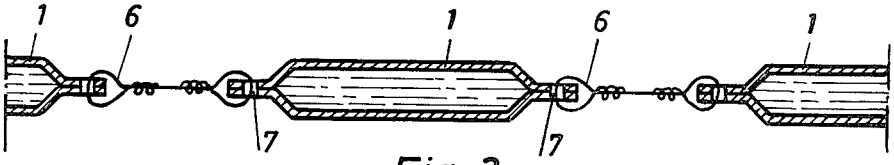
FIG. 3 is a cross-section through a capsule string, in which the capsules are connected by means of links and, FIG. 4 is a cross-section through a capsule string, in which the capsules are formed around and connected by means of a cable running through the capsules.

FIG. 2 shows a capsule string, in which the capsules 1 are formed by contractions 4 in the hose, the contracted hose parts being provided with perforations 5. In addition to the fact that the perforations facilitate suspension or nailing of the capsule string, the string can also serve as a basic material for the production of capsule strings in accordance with FIG. 3. FIG. 3 shows capsules 1 connected by means of links 6 attached to end parts 7 of the capsules end which end parts are provided with holes. By differentiating the lengths of the links, one can, by using a single-size capsule, differentiate the amount of fire-extinguishing means per meter of string and thereby meet various requirements of flame-guard capacity.

Figure 4:
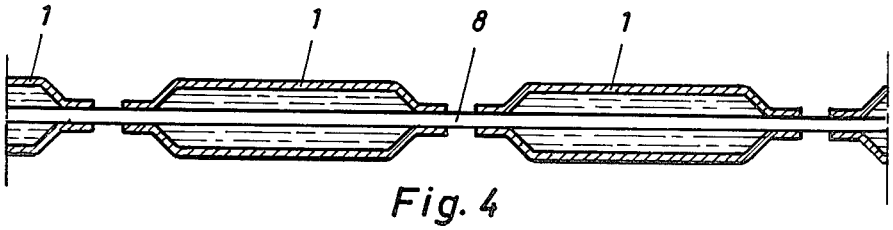

FIG. 4 shows a capsule string in which the capsules 1 are formed around and connected to a cable 8, which can be made of plastic material. The plastic cable functions partly as a uniting element for the capsules and, partly as a seal-arrangement for the capsules.

Flame-guard devices in accordance with the invention can be very simply installed both in already existing installations and in new installations due to the fact that the capsule strings are handled and placed in the same manner as electric cables. If an amplified flame-guard is required, several capsule strings can be used and it is also possible to partially amplify the flame-guard in critical regions (e.g., at inlets) by winding the capsule string around a cable-bundle. In case of fire, there will, in many cases, only be a limited number of capsules consumed and only a small part of the flame-guard will then be necessary to be replaced. The part of the flame-guard which has not been in contact with the fire will be intact.

We claim:

1. A flame protective device for electrical cable installations comprising a plurality of capsules secured together one after another to form a string, each of said capsules containing a substance having flame-extinguishing properties, said capsules being constructed to burst or open up when heated, thereby releasing said flame-extinguishing substance, the individual capsules being arranged in a line and a hose surrounding said capsules and maintaining the capsules in spaced positions in said line.

2. A flame protective device according to claim 1 wherein the flame-extinguishing substance consists of a halon, a halon-mixture or a halon-developing substance.

3. A flame protective device for electrical cable installations comprising a plurality of capsules secured together one after another to form a string, each of said capsules containing a substance having flame-extinguishing properties, said capsules being constructed to burst or open up when heated, thereby releasing said flame-extinguishing substance, said string of capsules including contracted portions between adjacent capsules which maintain the capsules in spaced positions in said string, said contracted portions being provided with apertures therein, said contracted portions including connecting links engaged in said apertures.

* * * * *